US005178393A

United States Patent [19]

Dennesen

[11] Patent Number: 5,178,393

[45] Date of Patent: Jan. 12, 1993

[54] METHOD AND APPARATUS FOR MEASURING GOLF DRIVING DISTANCE

[75] Inventor: James J. Dennesen, Haverhill, Mass.

[73] Assignee: Dennco, Inc., Salem, N.H.

[21] Appl. No.: 787,552

[22] Filed: Nov. 4, 1991

[51] Int. Cl.[5] ..... A63B 69/36

[52] U.S. Cl. ..... 273/184 B; 273/197 A

[58] Field of Search ..... 273/185 C, 185 D, 184 B, 273/184 R, 184 A, 185 R, 185 A, 185 B, 197 R, 197 A, 200 R, 200 B, 58 C, 176 FA

[56] References Cited

U.S. PATENT DOCUMENTS

| | | | |
|---|---|---|---|
| 3,815,922 | 6/1974 | Brainard | 273/184 B |
| 4,429,880 | 2/1984 | Chen et al. | 273/176 FA |
| 4,660,835 | 4/1987 | Lorurto | 273/58 C X |
| 4,971,326 | 11/1990 | Montone | 273/185 C |
| 5,035,432 | 7/1991 | Lew | 273/176 FA |

*Primary Examiner*—George J. Marlo
*Attorney, Agent, or Firm*—Choate, Hall & Stewart

[57] ABSTRACT

A method and apparatus for the measurement of the driving distance of a golf swing by measuring the initial velocity of a golf ball tethered by a string to a rotating axle.

2 Claims, 3 Drawing Sheets

METHOD AND APPARATUS FOR MEASURING GOLF DRIVING DISTANCE

BACKGROUND OF THE INVENTION

This invention relates to a method and apparatus for measuring the length of a golf drive within a very limited space. Their are currently no inexpensive and accurate means of measuring the driving range of a golf swing. By combining a compact design based on rotary motion with a very sensitive sensing scheme for the initial velocity of the ball, the invention disclosed herein allows for instant readouts of driving distance without requiring a large open space.

SUMMARY OF THE INVENTION

According to the invention, the apparatus for estimating the length of a golf drive includes a golf ball tethered to a rotatable axle at a preselected distance from the axle. A sensor is provided to measure the angular of velocity of the axle and circuitry is provided for calculating the estimated length of the drive from the initial velocity of the ball. Display apparatus displays the calculated estimated length. In a preferred embodiment, the initial velocity is calculated from the angular velocity of the axle and the preselected distance of the ball from the axle by means of a digital circuit.

DESCRIPTION OF THE PREFERRED EMBODIMENT

Figure 1:
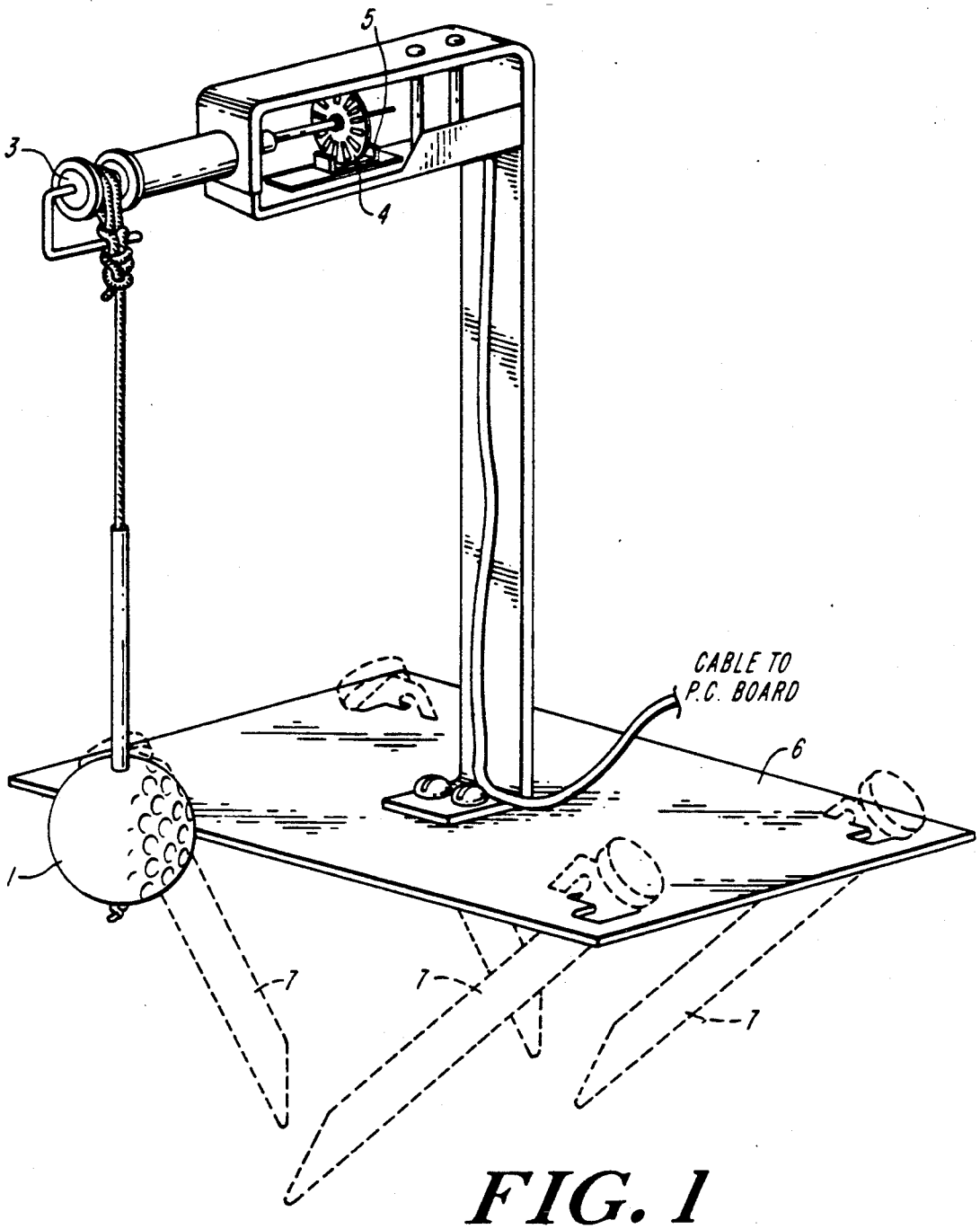
FIG. 1 is a perspective view of the apparatus for measuring driving distance.

With reference first to FIG. 1, a golf ball 1 is tethered by a string 2 to a rotatable axle 3. The axle 3 also carries a slotted disc 4 which cooperates with an optical source and receiver unit 5 for determining the angular velocity of the axle 3. As the slotted disc 4 rotates it alternately blocks and passes light creating electrical pulses which are conveyed by wires to the processing unit that performs the calculations as will be described herein below.

The apparatus of the present invention includes a base plate 6 which may be affixed to the ground by means of spikes 7.

Figure 2A:
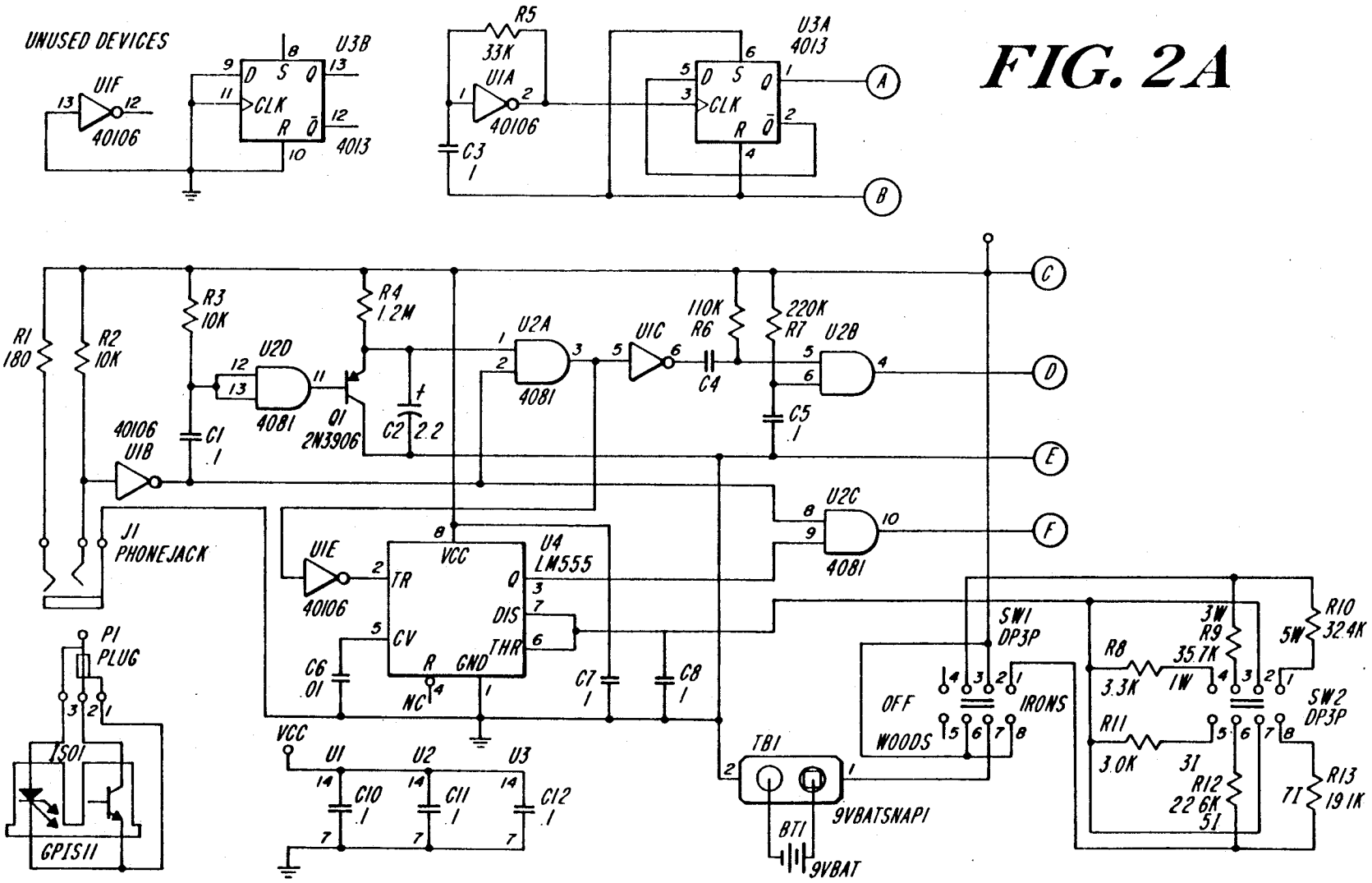
FIGS. 2A and 2B show a circuit diagram for the processor that calculates the driving distance.
Figure 2B:
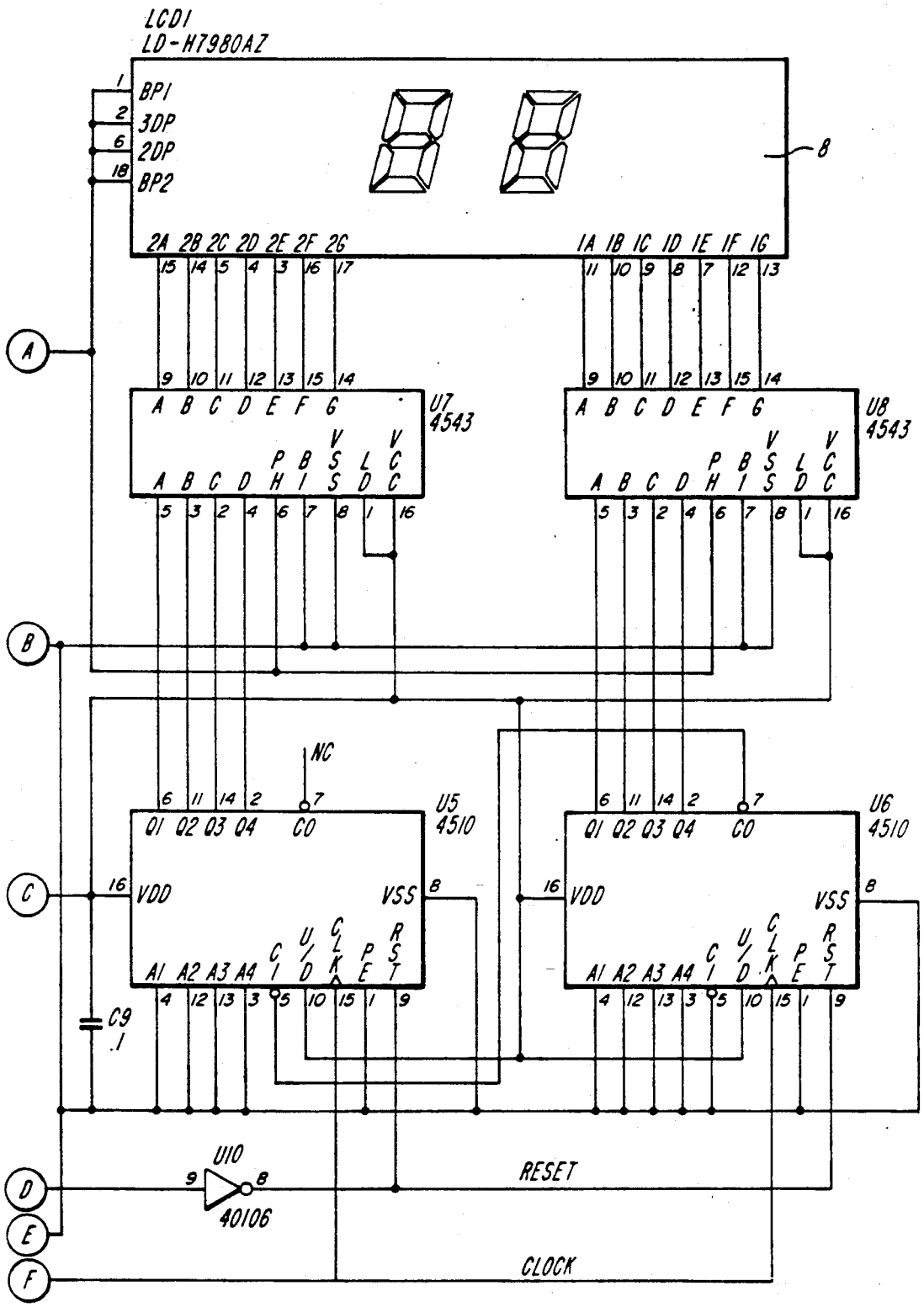

The output of the optical unit 5 serves as the input to the circuit diagram shown in FIG. 2. As will be appreciated by those skilled in the art, the circuit of FIG. 2 will calculate the distance that the ball would have traveled if untethered and can be programmed to use calibration constants based on field measurements. The estimated distance is displayed in liquid crystal display 8.

In operation, a golfer selects a club and strikes the ball which will then rotate on the axle 3. The particular club selected can serve as one of the calibration factors in computing the estimate of the distance. After striking the ball, the display 8 will show the estimate for the distance the ball would have traveled if untethered and struck with that particular club. Thereafter, the apparatus is reset for an additional swing. The calculation of the distance estimate is based on simple Newtonian mechanics as is well known to those in the ballistics arts.

What is claimed is:

1. Apparatus for estimating the length of a golf drive comprising:

a golf ball tethered to a rotatable axle at a preselected distance from the axle;

circuitry for calculating the estimated length of the drive from the initial velocity of the ball; and display apparatus to display said calculated estimated length.

2. Apparatus of claim 1 wherein the initial velocity is calculated from the angular velocity of the axle and the preselected distance of the ball from the axle.

* * * * *